US008919938B2

(12) United States Patent
Clark et al.

(10) Patent No.: US 8,919,938 B2
(45) Date of Patent: Dec. 30, 2014

(54) DROPLET GENERATOR

(75) Inventors: Garrett E. Clark, Albany, OR (US); Angela Bakkom, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1052 days.

(21) Appl. No.: 12/743,238

(22) PCT Filed: Dec. 20, 2007

(86) PCT No.: PCT/US2007/088421
§ 371 (c)(1),
(2), (4) Date: May 17, 2010

(87) PCT Pub. No.: WO2009/082391
PCT Pub. Date: Jul. 2, 2009

(65) Prior Publication Data

US 2010/0253748 A1 Oct. 7, 2010

(51) Int. Cl.
*B41J 2/05* (2006.01)
*B41J 2/19* (2006.01)
*B41J 2/14* (2006.01)

(52) U.S. Cl.
CPC .... *B41J 2/14145* (2013.01); *B41J 2002/14185* (2013.01); *B41J 2002/14387* (2013.01); *B41J 2002/14403* (2013.01); *B41J 2202/07* (2013.01)
USPC ..... 347/92; 347/67

(58) Field of Classification Search
USPC ..... 347/54, 56–67
See application file for complete search history.

(56) References Cited

U.S. PATENT DOCUMENTS

| | | | | |
|---|---|---|---|---|
| 6,162,589 | A | 12/2000 | Chen et al. | |
| 7,226,149 | B2 | 6/2007 | Stout et al. | |
| 7,431,434 | B2 * | 10/2008 | Agarwal et al. | 347/65 |
| 2002/0060350 | A1 | 5/2002 | Schulte et al. | |
| 2004/0223034 | A1 | 11/2004 | Feinn et al. | |
| 2005/0145982 | A1 | 7/2005 | Chavarria | |
| 2005/0259123 | A1 | 11/2005 | Rice et al. | |
| 2005/0270332 | A1 | 12/2005 | Strand et al. | |
| 2006/0028511 | A1 * | 2/2006 | Chwalek et al. | 347/65 |
| 2006/0262161 | A1 | 11/2006 | Rice et al. | |
| 2006/0268067 | A1 | 11/2006 | Agarwal et al. | |

(Continued)

FOREIGN PATENT DOCUMENTS

EP 1680278 10/2007

OTHER PUBLICATIONS

"Using SU8 primer layer method to control a wicked adhesive in fuse chambers", Research Disclosure Journal, ISSN 0374-4353. Aug. 2005. pp. 1-3. Research Disclosure Database No. 496053, Kenneth Mason Publications Ltd., The Book Barn, Westbourne, Hants. PO10 8RS. UK.

(Continued)

*Primary Examiner* — Jerry Rahll

(57) ABSTRACT

A droplet generator (100, 600, 700) having a bubble purging fluidic architecture comprises a firing chamber (110, 610, 710); an inlet (155, 655) fluidically connecting the firing chamber (110, 610, 710) to a fluid reservoir (140, 640, 740); and an outlet (120, 400, 620, 720) configured to pass fluid droplets being ejected from the firing chamber (110, 610, 710). The geometry of the outlet (120, 400, 620, 720) and the geometry of the inlet (155, 655) are configured such that the outlet (120, 400, 620, 720) geometry has a substantially lower barrier to expansion or motion of a bubble (300, 310, 410) than the inlet (155, 655) geometry.

20 Claims, 8 Drawing Sheets

(56) References Cited

U.S. PATENT DOCUMENTS

| | | | |
|---|---|---|---|
| 2007/0103501 | A1 | 5/2007 | Hatsui et al. |
| 2007/0194371 | A1 | 8/2007 | Benjamin |
| 2007/0245559 | A1 | 10/2007 | Feinn et al. |

OTHER PUBLICATIONS

Supplementary European Search Report for Application No. EP07869681.2 Report issued Jan. 31, 2011.

* cited by examiner

DROPLET GENERATOR

BACKGROUND

Thermal inkjet technology is widely used for precisely and rapidly dispensing small quantities of fluid. Thermal inkjets eject droplets of fluid out of an orifice by using heating elements to vaporize small portions of the fluid within a firing chamber. The vapor rapidly expands, forcing a small droplet out of the orifice. The heating element is then turned off and the vapor rapidly collapses, drawing more fluid into the firing chamber from a reservoir.

The fluids stored in the reservoir and dispensed through the orifices can absorb and hold gases, such as atmospheric nitrogen, oxygen, or carbon dioxide. Under certain conditions, these gases can come out of the solution and form bubbles. These gas bubbles can become trapped in the firing chambers and prevent drop ejection, resulting in print defects and reduced print quality.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

As noted above, air bubbles present an issue in inkjet printheads because such bubbles can become trapped in the firing chambers and prevent drop ejection, resulting in print defects or reduced print quality.

Because the bubbles collect gas dissolved in the ink, the bubbles continue to grow and are difficult to remove. However, as will be described herein, creating a flow path into the firing chamber that is more restrictive to bubble growth encourages these bubbles to expand out of the firing nozzle and break, allowing fluid to refill the firing chamber. This has application regardless of the fluid that the device is ejecting. While originally developed to precisely eject ink in printing applications, inkjet technology is now used in a wide variety of fields where a fluid is to be dispensed or ejected with precision. The principles described in this specification may consequently apply to a wide variety of fluids, including ink, being dispensed by an inkjet head.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
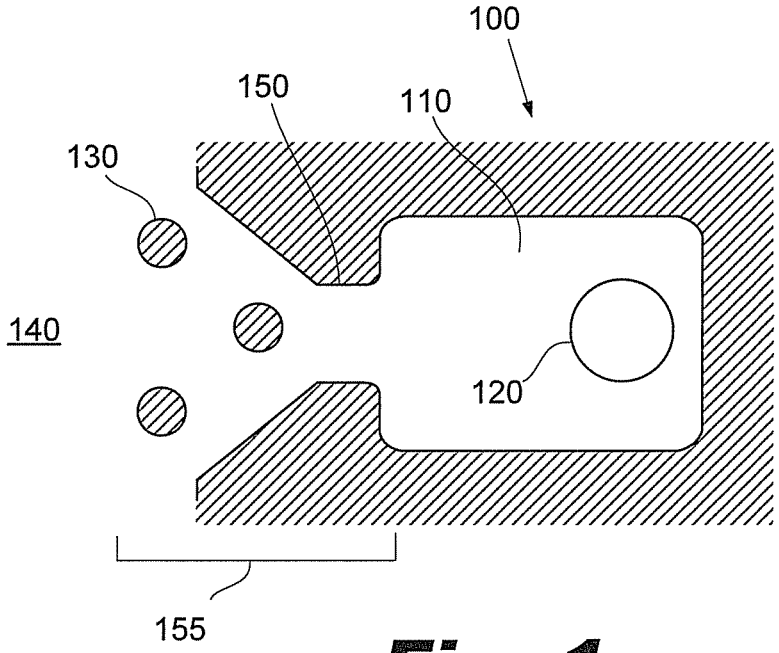
FIG. 1 is a diagram of an illustrative embodiment of a droplet generator, according to principles described herein.

FIG. 1 is an illustrative top view of one embodiment of a droplet generator (100) within a fluid-jet, such as a thermal inkjet printhead. The droplet generator (100) consists, of a firing chamber (110), a nozzle (120), and an inlet geometry (155) comprising a plurality of islands (130) and a throat (150). The inlet geometry (155) fluidically connects the firing chamber (110) with the fluid reservoir (140). Ordinarily, fluid is drawn from the fluid reservoir (140) past the islands (130), through the throat (150) and into firing chamber (150). The combination of the islands (130) and the throat (150) prevent particles greater than a particular size from entering the firing chamber (110).

Because of the small size of the droplet generator (100), capillary force/surface tension is a predominant force affecting the interaction of fluids with solids or gas. The capillary action occurs when the external intermolecular forces between the liquid and the solid walls are stronger than the cohesive intermolecular forces inside the liquid. The capillary forces tend to draw the fluid into the firing chamber (110) and hold it there.

Figure 2:
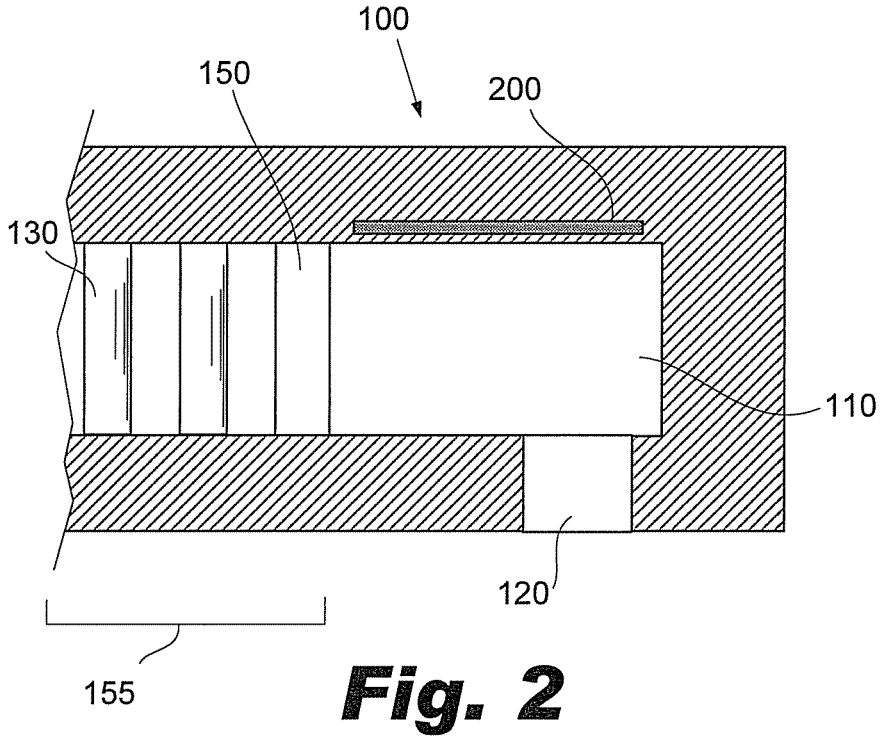
FIG. 2 is a cross-sectional view an illustrative embodiment of a droplet generator, according to principles described herein.

FIG. 2 is a cross-sectional view of one embodiment of a droplet generator (100). This cross-sectional view shows a firing chamber (110), the inlet geometry (155) and the nozzle (120). Fluid is drawn from the reservoir (140, FIG. 1) into the firing chamber (110) by capillary action or by other forces. Under isostatic conditions, the fluid does not exit the nozzle (120), but forms a concave meniscus within the nozzle exit.

To eject a droplet from the droplet generator (100), a heating element (200) is proximally located to the firing chamber (110). Electricity is passed through the heating element (200), which causes the temperature of the heating element (200) to rapidly rise and vaporize a small portion of the fluid immediately adjacent to the heating element (200). The vaporization of the fluid creates rapidly expanding vapor which overcomes the capillary forces retaining the fluid within the firing chamber (110) and nozzle (120). As the vapor continues to expand, a droplet is ejected from the nozzle (120).

Following the formation of the vapor bubble, the electrical current through the heating element (200) is cut off and the heating element (200) rapidly cools. The envelope of vaporized fluid collapses, pulling additional fluid from the reservoir into firing chamber (110) to replace the fluid volume vacated by the droplet. Additionally, capillary forces tend to draw the fluid into the firing chamber (110). The droplet generator (100) is then ready to begin a new droplet ejection cycle. Ordinarily, the droplet generators (100) should be full of fluid so that they can consistently eject a droplet toward the printing media.

The flow of fluid through the firing chamber (110) is the primary cooling mechanism for the droplet generator (100). A significant portion of the heat generated by the heating element (200) is absorbed by the surrounding liquid which is then ejected through the nozzle (120).

The size of the droplet that is ejected is determined by the geometry of the firing chamber, the capacity and operation of the heating element, the material properties of the fluid, and other factors. In many cases extremely small drops (with masses of 1-10 nanograms) can be ejected at high frequencies from the firing chamber.

A plurality of droplet generators (100) may be contained within a single fluid-jet or inkjet die. In some circumstances, the inkjet die may be heated using separate resistive heating elements prior to printing. By heating the inkjet die prior to the use of the droplet generators (100); heating surges caused by the individual heating elements (200) within the droplet generators (100) can be minimized. Maintaining an inkjet die in a substantially isothermal state during printing reduces undesirable changes in the printing performance of the die.

As noted above, air bubbles can be a problem within inkjet die because the air bubbles can become trapped in the firing chambers and prevent droplet ejection. One possible mechanism for bubbles to form within the firing chamber is for gas dissolved within the fluid to come out of solution, thereby creating a bubble. The elevated temperature of the inkjet die, in some circumstances, decreases the amount of gas that a fluid can maintain in solution. As the temperature rises, the gas is forced out of the fluid and forms bubbles. The firing chambers, particularly during heavy printing demands, can have higher temperatures than other areas or surfaces that the fluid contacts. Because of the higher temperature, bubbles may be more prone to nucleating within the firing chambers.

As indicated, the elevated temperatures created in thermal inkjet printers encourage air dissolved in the fluid to come out of solution and create bubbles that fill the firing chambers, causing print defects and reduced print quality. When a bubble forms within the firing chamber, the droplet ejection mechanism may no longer be viable. The heating element (200) continues to cycle on and off, but there may be insufficient fluid proximal to the heating element (200) to create a vapor bubble to push fluid out of the firing chamber (110). Additionally, there may be insufficient fluid within the chamber to actually eject a droplet even if a vapor bubble is created. In the absence of fluid flowing through the firing chamber, the temperature of the firing chamber can rise dramatically. The rising temperature within the firing chamber increases the rate at which gas escapes the fluid, thereby causing any bubble nucleating in the firing chamber to increase in size, thereby aggravating the situation. As long as the temperature remains elevated, these bubbles will continue to grow and prevent the firing chamber from functioning.

Air can be removed from the firing chambers by several methods. For example, vacuum priming restores proper function but consumes fluid, thereby increasing costs. Another method is to reduce the head temperature, which decreases the tendency for gasses in the fluid to come out of solution. With faster printing or dispensing speeds, however, lower temperatures cannot always be maintained. Another solution is to use "degassed" fluid in the fluid supplies. The degassing process removes gas dissolved in the fluid to be dispensed, so that such gas cannot later come out of solution and create bubbles. Systems that rely on this method, however, use expensive materials that prevent air from redissolving back into the fluid while the supplies wait for the customer to buy or use the fluid. Even with expensive packaging materials, the fluid can only be protected for a limited amount of time. This limits the effectiveness of the degassing process to relatively high fluid usage customers who will typically consume the fluid after a short period of time.

Figure 3A:
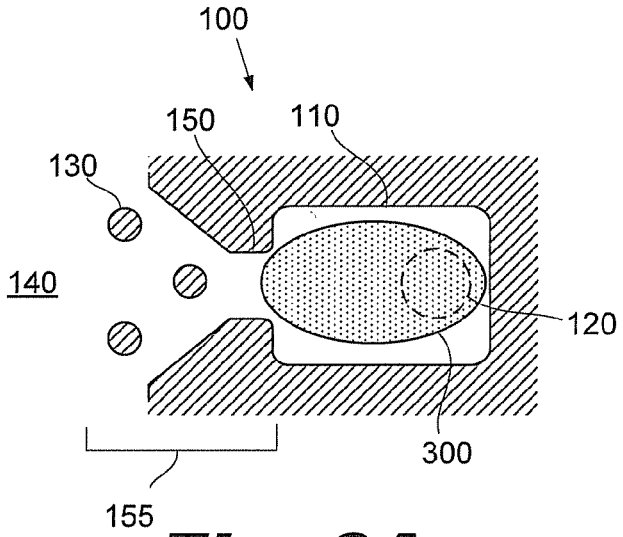
FIGS. 3A through 3F are diagrams showing an illustrative time sequence of bubble development within a droplet generator where the bubble is trapped within a firing chamber, according to principles described herein.

FIGS. 3A through 3F are illustrative diagrams showing a time sequence of bubble development within a droplet generator (100). FIG. 3A shows a droplet generator (100) comprising a firing chamber (110), an inlet geometry (155), and a nozzle (120). Within the firing chamber (110) an air or gas bubble (300) has formed. The bubble (300) at this point does not substantially fill the firing chamber and may not be in direct contact with the nozzle (120), the throat area (150), or the islands (130).

Figure 3B:
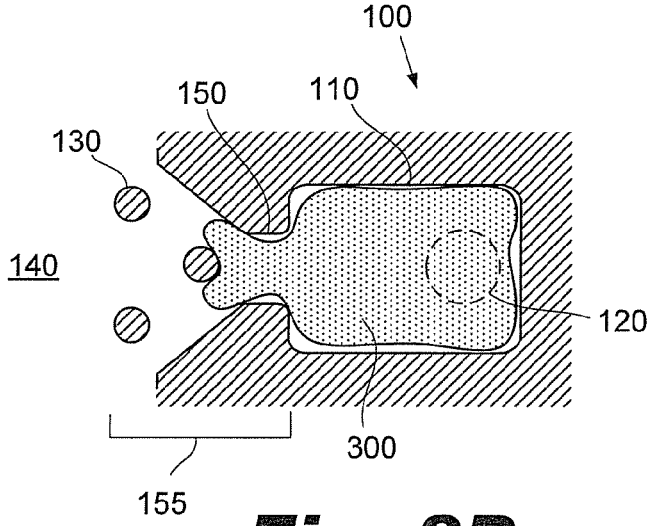

FIG. 3B shows the bubble (300) continuing to expand, possibly as a result of the increased temperature within the firing chamber (110). As the bubble (300) continues to expand, it extends through the throat (150) and contacts an island (130) as shown in FIG. 3B. The bubble (300) additionally displaces fluid within the firing chamber (110) and comes into contact with the nozzle (120).

Figure 3C:
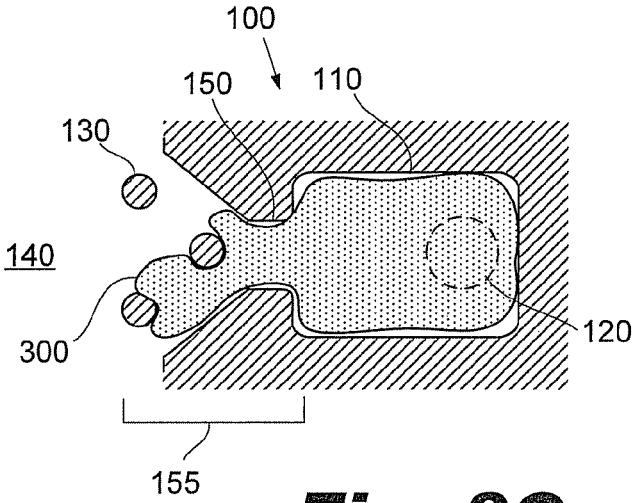

FIG. 3C shows the bubble (300) continuing to grow. The pressure within the bubble (300) is uniform and exerts an equal force over the entire interior surface of the bubble (300). The smallest radius of curvature in the bubble wall determines the interior pressure of the entire bubble (300). For example, as the bubble expands through the throat area (150), it encounters an island (130) as shown in FIG. 3B. The narrow passageway causes the portion of the bubble between the island (130) and the nearest wall form a small radius of curvature as the bubble pushes through the narrow passageway. This causes the pressure within the bubble (300) to increase, thereby exerting a greater force exerted over the entire interior wall of the bubble (300).

This internal pressure within the bubble (300) causes the bubble (300) to expand in a direction of least resistance. The direction of least resistance can be defined as the direction in which the bubble (300) can expand with the largest radius of curvature, which typically corresponds to the largest opening or open space at the perimeter of the bubble (300).

Figure 3D:
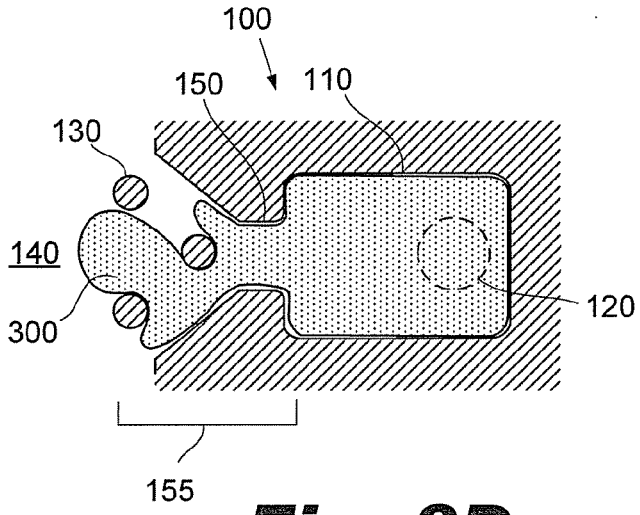
Figure 3E:
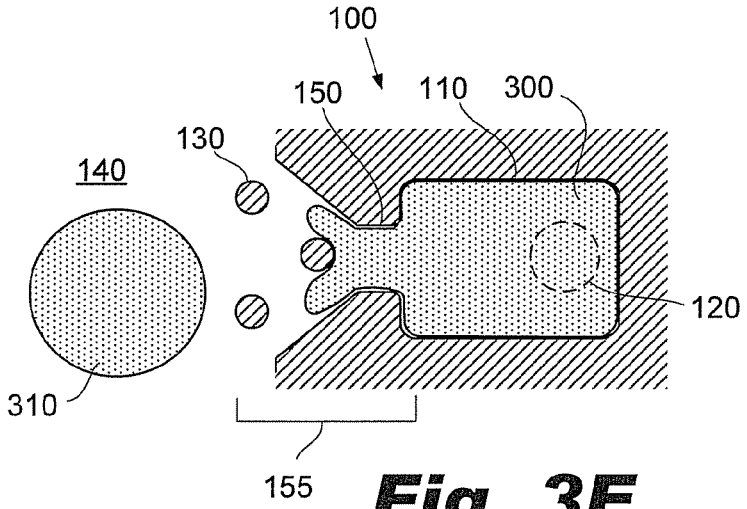
Figure 3F:
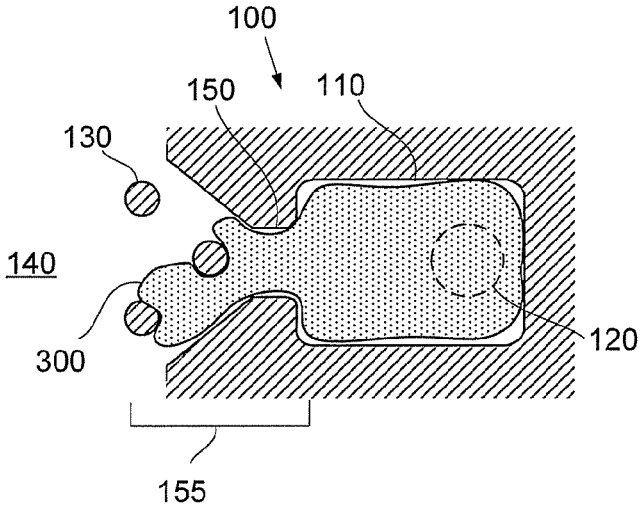

In this case, the path of least resistance for the expansion of bubble (300) is through the inlet geometry (155). FIG. 3D shows the bubble continuing to grow and passing through the narrow openings between the islands (130) and the throat walls (150). When enough of the bubble (300) protrudes out of the inlet geometry (155), the protruding portion may separate from the original bubble (300) to create a new bubble (310) that floats within the fluid reservoir (140), as shown in FIG. 3E. After the new bubble (310) separates, the original bubble (300) continues to grow, starting the process of shedding another bubble into the fluid reservoir again, as seen in FIG. 3F. In such a case, the firing chamber (110) will remain full of the gas bubble and inoperable until the temperature is reduced and the gas redissolves into the fluid.

The pressure needed to push a bubble (300) through an opening can be defined for a circular orifice by the following equation:

$$P=(2\,\sigma\cos(\theta-\alpha))/r \qquad \text{(Eq. 1)}$$

Where:

P=interior bubble pressure $\sigma$=fluid surface tension $\theta$=fluid contact angle $\alpha$=nozzle taper angle r=nozzle radius As can be seen from the equation above, the pressure needed to push a bubble through a circular opening decreases as the radius of the opening increases. It is easier for a bubble to pass through a large opening than a small opening.

The pressure needed to push a bubble through a rectangular opening, such as the openings created by the throat (150) or islands (130) can be defined by the following equation:

$$P=(\sigma \cos(\theta-\alpha))/(h+w) \quad \text{(Eq. 2)}$$

Where:

P=interior bubble pressure
σ=fluid surface tension
θ=fluid contact angle
α=taper angle
h=height of the rectangular opening
w=width of the rectangular opening.

For the bubbles to be purged from the firing chamber through the nozzle (120), the path of least resistance to expansion needs to be the nozzle (120), not the firing chamber inlet (155). Creating a flow path into the firing chamber (110) that is more restrictive to bubble growth encourages these bubbles to expand out of the nozzle (120) and break, allowing fluid to refill the firing chamber.

By setting Eq. 1 and Eq. 2 equal to each other and assuming that the taper angles a for both the inlet geometry (155) and the nozzle (120) are zero or are small enough to be neglected, the critical nozzle radius can be found for a given inlet geometry.

$$2/r_c=1/h+1/w \quad \text{(Eq. 3)}$$

Where $r_c$=critical radius
h=height of the rectangular opening
w=width of the rectangular opening Solving for the critical radius results in the critical radius being expressed as a function of the height and width of the opposing rectangular opening in the inlet geometry (155).

$$r_c=(2*h*w)/(h+w) \quad \text{(Eq. 4)}$$

When the left side of Eq. 3 or Eq. 4 is equal to the right side of the corresponding Eq. 3 or Eq. 4, the bubble pressure needed to pass through the nozzle and the inlet geometry are equal. The nozzle radius for this condition will be called the critical nozzle radius. Eq. 3 and Eq. 4 describe the situation where resistance to bubble growth is equal in both directions. The two sides of this equation may not necessarily be equal for all printheads. For example, for some self purging printheads it would be expected that the left hand portion of Eq. 3 would be substantially smaller than the right hand side of the same equation. This reflects the lower resistance of the nozzle to the passage of a bubble.

For geometries with a significant taper angle α, it can be shown that:

$$P_{bp}+2\sigma\frac{\left(1-\sin\alpha-\frac{\cos\alpha}{\tan\alpha}\right)}{\left(-\frac{2\sigma}{P_a-P_{bp}}+\sqrt{\left(\frac{2\sigma}{P_a-P_{bp}}\right)^2-r_c^2}-\frac{r_c}{\tan\alpha}\right)}=\sigma\cos\theta\left[\frac{1}{h}+\frac{1}{w}\right] \quad \text{(Eq. 5)}$$

Where:

$r_c$=critical radius
h=height of the rectangular opening
w=width of the rectangular opening
$P_{bp}$=internal pen backpressure
$P_a$=atmospheric pressure
σ=fluid surface tension
α=nozzle taper angle.

To obtain a more precise characterization of the critical radius for nozzle geometries with a significant taper angle a, appropriate values can be inserted into Eq. 5.

If the nozzle radius is smaller than the critical nozzle radius, the bubble (300) remains trapped within the firing chamber (110) as shown by FIGS. 3A through 3F. If the nozzle radius is larger than the critical nozzle radius, the bubble (300) will exit through the nozzle. The bubble (300) bulges out of the nozzle into the atmosphere where the bubble meniscus will break. Capillary pressure then draws fluid into firing chamber (110), pushing the gasses which were inside the bubble out the nozzle. The firing chamber (110) is then filled with fluid and is ready to operate.

Figure 4A:
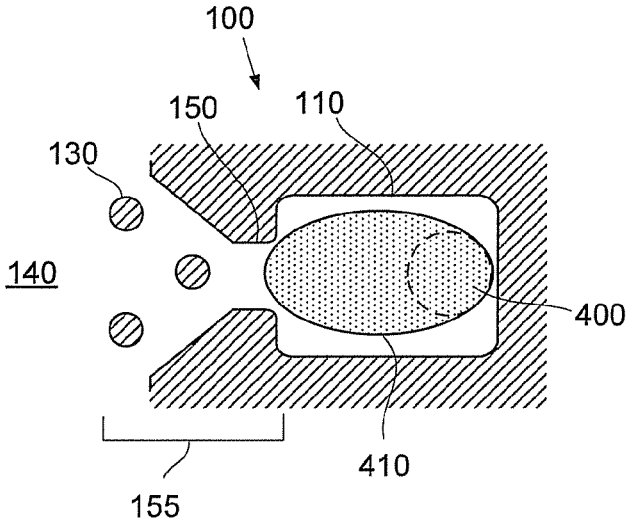
FIGS. 4A through 4F are diagrams showing an illustrative time sequence of bubble development and motion within a droplet generator that is configured to purge bubbles through a nozzle, according to principles described herein.

FIGS. 4A through 4F are illustrative diagrams showing a time sequence of bubble development within a droplet generator (100) which has a nozzle radius greater than the critical nozzle radius. FIG. 4A shows a droplet generator (100) comprising a firing chamber (110), an exit nozzle (400), a throat (150), and islands (130). The inlet (155) to the firing chamber (110) comprises the islands (130) and throat (150). The inlet (155) connects the fluid reservoir (140) to the firing chamber (110). As shown in FIG. 4A, a bubble (410) has formed within the firing chamber (110). The bubble (410) at this point does not substantially fill the firing chamber (110) and has not come in direct contact with the nozzle (400) or inlet geometry.

Figure 4B:
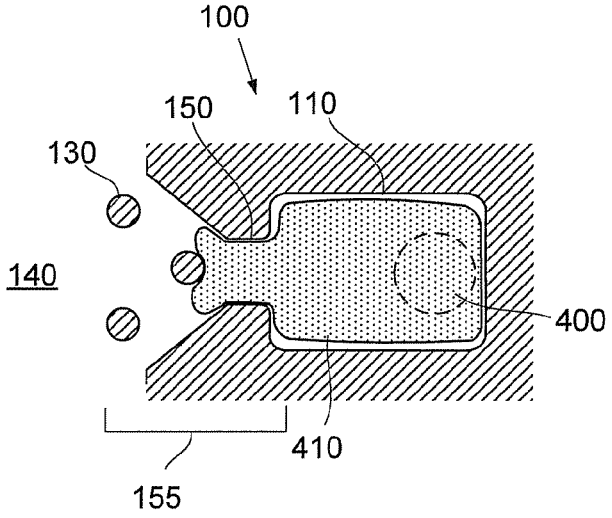

FIG. 4B shows the bubble (410) continuing to expand as gasses within the fluid continue to come out of solution. The bubble (410) continues to grow until it contacts the inlet geometry (155) and the nozzle (400). The pressure inside the bubble (410) increases and the bubble (410) moves toward the opening that creates the least resistance to expansion. In this case, the enlarged nozzle orifice (400) is the path of least resistance for bubble expansion.

Figure 4C:
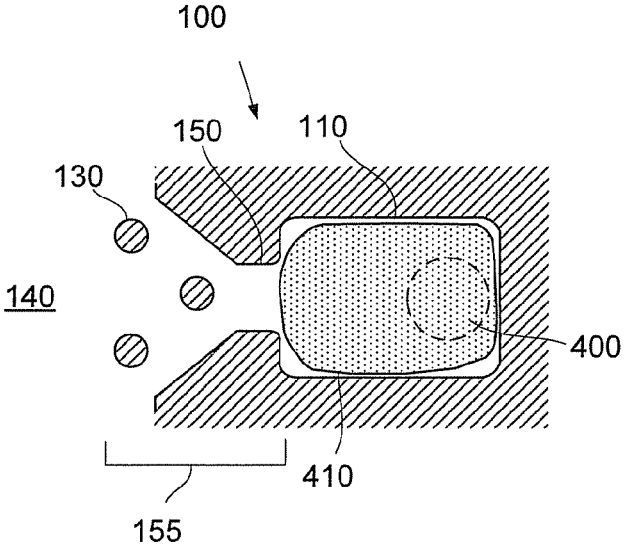
Figure 4D:
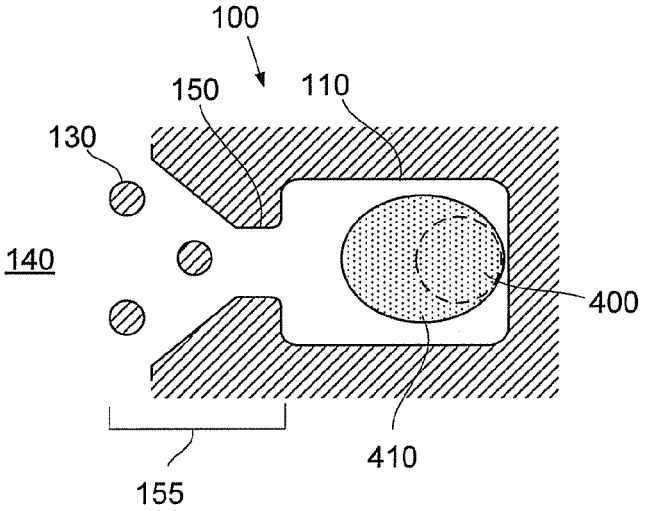
Figure 4E:
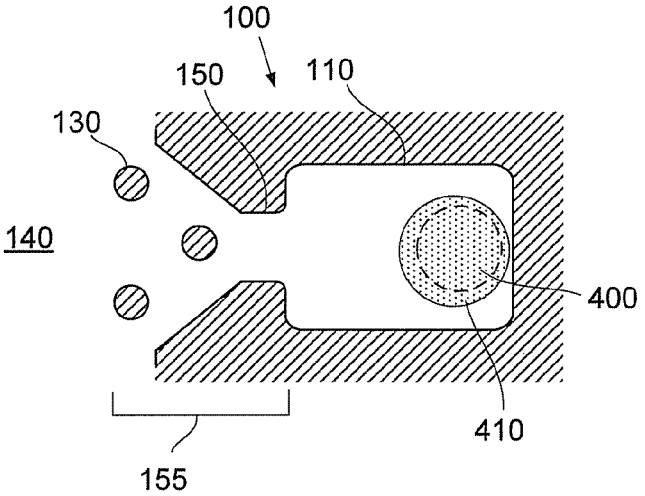
Figure 4F:
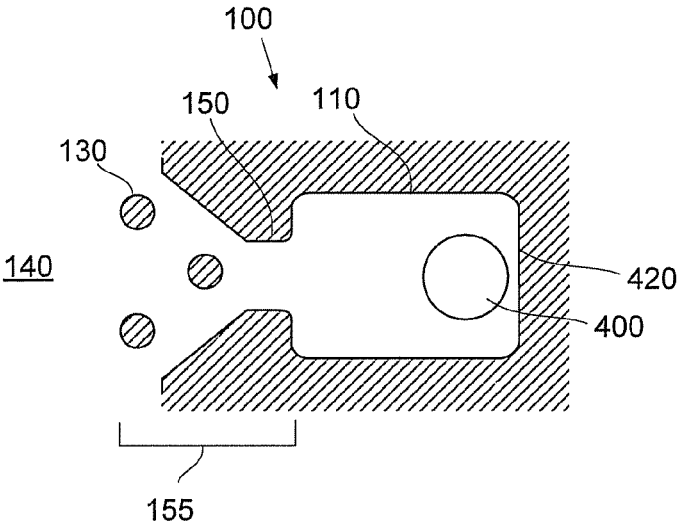

FIG. 4C shows the bubble (410) entering the nozzle (400). The bubble (410) moves into the nozzle (400) and breaks as it exits the nozzle (400) into the air. FIGS. 4D and 4E show the capillary forces drawing more fluid into the firing chamber (110) and forcing the remaining gas to exit through the nozzle (400). FIG. 4F shows the firing chamber completely filled with fluid and ready to operate.

Other parameters within the droplet generator (100) can be altered to reduce the incidence of bubbles within the firing chamber (110). According to one exemplary embodiment, the nozzle (400) is placed as close as possible to the rear wall (420) of the firing chamber (110). By moving the nozzle closer to the back wall, there is a more uniform flow of fluid through the firing chamber. Stagnation points that could occur between the rear wall (420) and the nozzle orifice are minimized, thereby increasing the likelihood that bubbles that form in the stagnation areas will be swept out of the nozzle (400).

Creating self purging fluidic architectures for low drop weight droplet generators can be challenging. For a very small droplet to be generated, the nozzle, inlet geometry, and firing chamber are correspondingly small. In some cases, manufacturing constraints can place a lower limit on dimensions of the inlet or other geometry, resulting in a firing chamber that is not self purging. Recent advances in manufacturing techniques have allowed for smaller inlet structures, enabling self purging architectures even for low drop weight nozzles.

Figure 5:
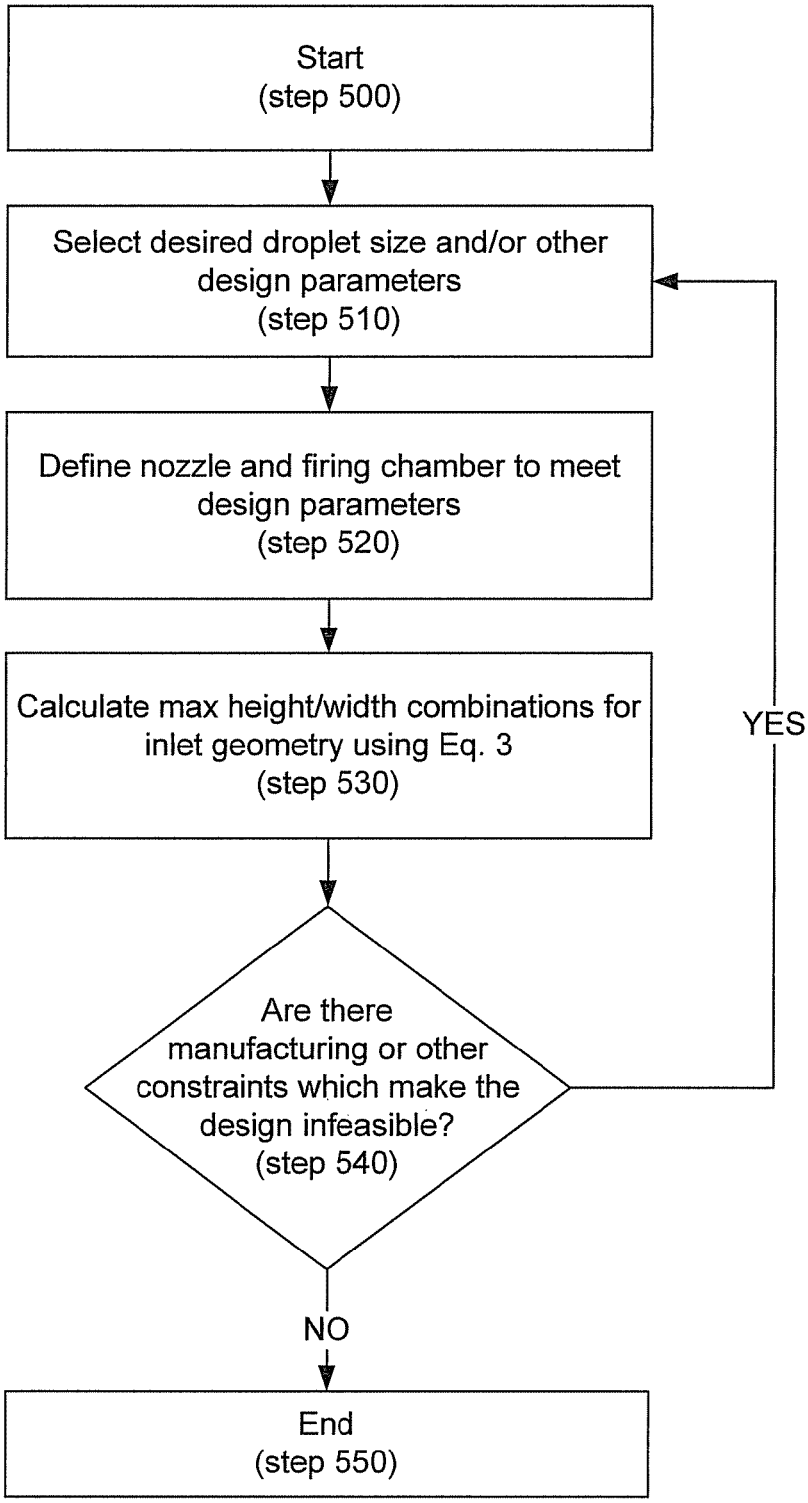
FIG. 5 is a flowchart which shows one illustrative embodiment of a method for designing a self purging droplet generator, according to principles described herein.

FIG. 5 is an illustrative flow chart showing one exemplary embodiment of a process for designing a self purging fluidic architecture with an inkjet droplet generator. The process starts (step 500) and the desired droplet size and/or other parameters are selected (step 510) that define the performance goals of the inkjet die. According to one exemplary embodiment, the firing chamber and nozzles are then designed such that the performance parameters are met (520). Then using Eq. 3, or another similar equation, the maximum height/width combinations are determined for the inlet geometry (step 530). Following the design of the inlet geometry, a check is made to determine if there are manufacturing or other constraints which make the design infeasible (step 540). If the design is determined to be infeasible, the design parameters can be altered and the design process (steps 510 through 540) can be repeated. If a design which meets the desired parameters has been found the process can end (step 550).

Figure 6:
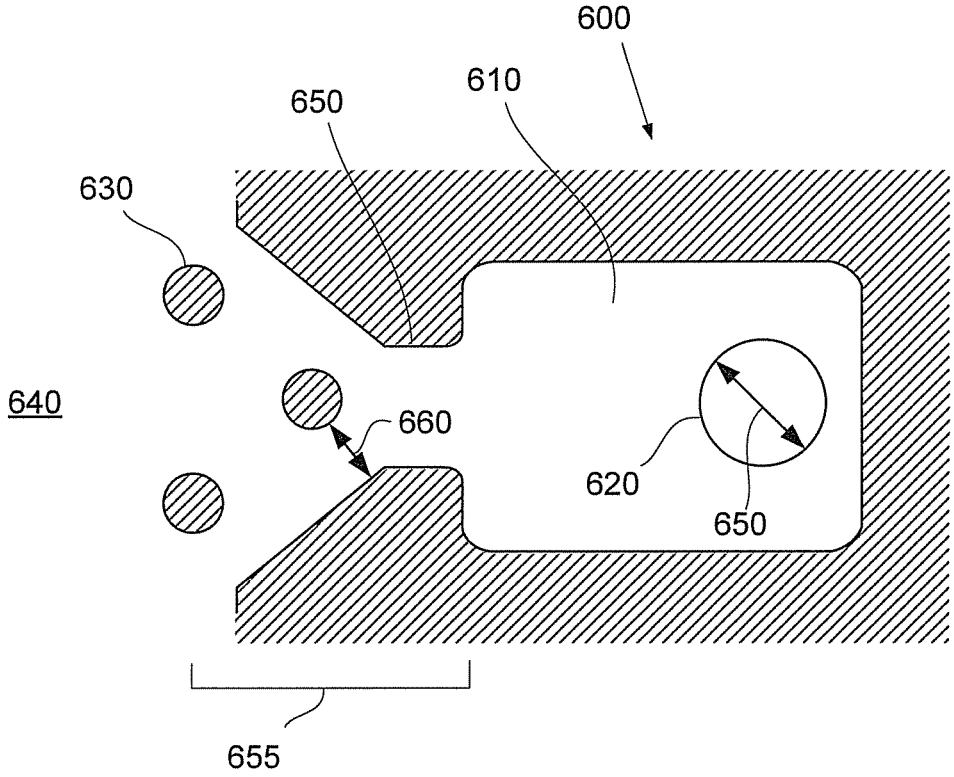
FIG. 6 is a diagram showing one illustrative embodiment of a geometry for a self purging droplet generator, according to principles described herein.

FIG. 6 is an illustrative plan view of an exemplary self purging fluidic architecture for an inkjet die. As described above, the droplet generator (600) comprises of a firing chamber (610), inlet geometry (655) comprising the throat (650) and islands (630), and a nozzle (620). The inlet geometry fluidically connects the firing chamber (610) to the fluid reservoir (640). The islands (630) and the throat (650) are designed to prevent particles larger than a certain size from entering the firing chamber. The nozzle (620) is configured to pass fluid droplets ejected from firing chamber onto a substrate, for example, a sheet of print medium.

A first double headed arrow (650) represents the diameter of the nozzle (620). In this example, the diameter of the nozzle is 15.2 microns. The radius of the nozzle (620) is half of the diameter, or 7.6 microns. The second double headed arrow (660) represents the limiting rectangular opening within the inlet geometry. In this example, the width of the opening (660) is 5 microns and the vertical height of the opening is 14 microns.

Using Eq. 4 and substituting in the numerical values for the width and height of the inlet opening, it can be found that the critical radius for this design is 7.4 microns. The nozzle radius is 7.6 microns which is greater than the critical radius of 7.4 microns. Because the nozzle radius is greater than the critical radius, it is expected that droplet generator (600) would be self purging. Bubbles that form within the firing chamber (610) would follow the path of least resistance out of nozzle (620) where the bubbles would break, allowing more fluid to pass from the reservoir (640) through the inlet geometry (655) and into the firing chamber (610). The firing chamber (610) would then be ready to resume its normal operation.

Figure 7A:
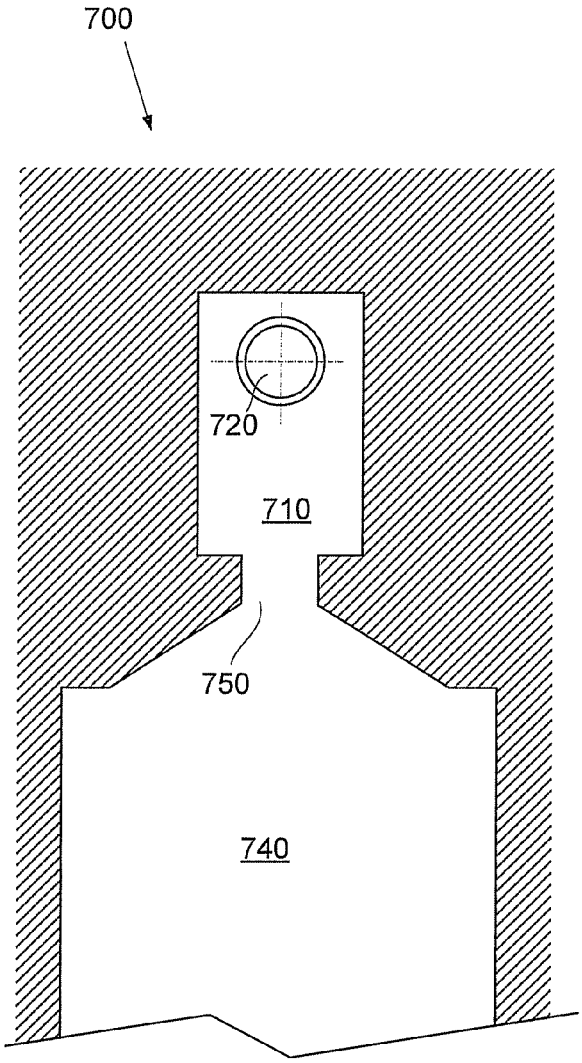
FIGS. 7A and 7B are an illustrative cross-sectional plan view and an illustrative cross-sectional side view, respectively, of one exemplary embodiment of single inlet inkjet die architecture, according to principles described herein.
Figure 7B:
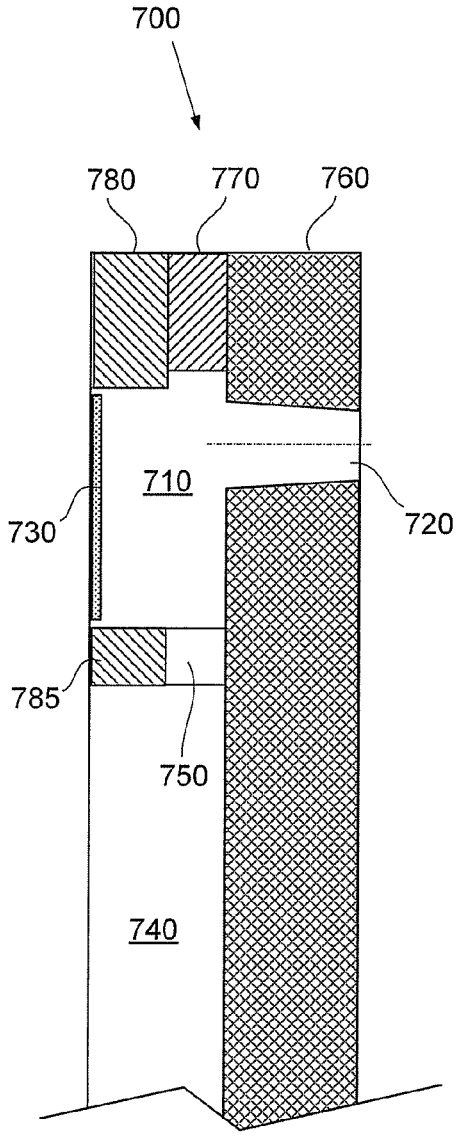

FIGS. 7A and 7B are an illustrative cross-sectional plan view and an illustrative cross-sectional side view, respectively, of one exemplary embodiment of single inlet inkjet die architecture. FIG. 7A shows a droplet generator (700) which comprises of a firing chamber (710), a throat (750), and a nozzle (720). As previously described, the throat (750) fluidically connects the firing chamber (710) to the fluid reservoir (740). In this embodiment, the height and width of the nozzle cross-section are the primary inlet variables, and the nozzle radius is the primary outlet variable.

FIG. 7B is an illustrative cross-sectional side view of the single inlet inkjet die architecture of FIG. 7A. FIG. 7B shows the nozzle (750) fluidically connecting the firing chamber (710) and the fluid reservoir (750). A heating element (730) is disposed on one side of the firing chamber (710) and the nozzle (720) is disposed on the opposing side. In FIG. 7B, the nozzle (720) has a noticeable taper, indicating that Eq. 5 may produce a more accurate estimate of the required inlet and outlet dimensions that would allow this particular inkjet geometry to be self purging.

FIG. 7B also shows one exemplary embodiment of layers that form the firing chamber geometry. A first layer (760) forms the layer within which the nozzle (720) is disposed. A second layer (770) forms portions of the wall and defines the throat (750) height. According to one exemplary embodiment, the second layer (770) is a primer SU8 layer. A third layer (780, 785) is adjacent to the second layer (770) and forms additional portions of the firing chamber wall and bounds the inlet opening on one side. According to one exemplary method, the inlet geometry can be altered to produce a self purging inkjet firing chamber. By way of example and not limitation, the relative thicknesses of the second layer (770) and third layer (780) can be changed to alter the height of nozzle (750) inlet area. For example, if the second layer (770) was thinner, while the third layer (780) was correspondingly thicker, the height of the nozzle (750) inlet would be reduced and become more restrictive to bubble motion. The bubble could then expand out the nozzle and burst, allowing the gas to exit and the bubble to collapse.

In sum, droplet generators can be designed to be self purging as to the formation of gas bubbles from gasses in solution in the printing fluid. This can be accomplished by changing the balance between the inlet and outlet geometries such that the outlet geometry presents a lower resistance to bubble motion and growth Bubbles which then form within the firing chamber naturally exit through the nozzle and break. This allows capillary forces and the droplet generator action to refill the firing chamber. The firing chamber is then ready to operate normally. This self purging geometry allows the firing chambers to be self recovering without adding any cost or complexity to the printing system.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A droplet generator having a bubble purging fluidic architecture comprises:

a firing chamber;

an inlet fluidically connecting said firing chamber to a fluid reservoir; and an outlet configured to pass fluid droplets being ejected from said firing chamber;

wherein a geometry of said outlet and a geometry of said inlet are configured such that said outlet geometry has a substantially lower barrier to expansion or motion of a bubble than said inlet geometry; and wherein said geometry of said inlet comprises a throat and an island.

2. The droplet generator of claim 1, wherein said outlet geometry comprises a nozzle with a substantially circular orifice; said substantially circular orifice being defined by a nozzle radius.

3. The droplet generator of claim 2, wherein said inlet geometry comprises a generally rectangular aperture.

4. The droplet generator of claim 3, wherein said nozzle radius is greater than a critical radius.

5. The droplet generator of claim 4, wherein said critical radius is calculated using variables describing said inlet geometry.

6. The droplet generator of claim 5, wherein said outlet geometry further comprises a taper angle; said taper angle of said outlet geometry being small such that said critical radius can be approximated using the equation $2/rc = 1/h + 1/w$; wherein rc equals said critical radius, h equals a height of a rectangular opening in said inlet geometry, and w equals a width of said rectangular opening.

7. The droplet generator of claim 1, wherein said outlet is located proximate to a back wall of said firing chamber effective to improve uniformity of fluid flow through said firing chamber and reduce stagnation points between said back wall and said outlet.

8. A fluid-jet die having a self purging droplet generator comprising:

a firing chamber;

an inlet geometry comprising a throat and at least one island, said inlet geometry fluidically connecting said firing chamber to a fluid reservoir; and a nozzle comprising a substantially circular orifice, said substantially circular orifice being defined by a nozzle radius, said nozzle being configured to pass fluid droplets ejected from said firing chamber;

wherein said inlet geometry and said nozzle are configured such that said nozzle geometry is a substantially lower barrier to expansion or motion of a bubble contained with said firing chamber than said inlet geometry.

9. The droplet generator of claim 8, wherein said nozzle radius of said substantially circular orifice is greater than a critical radius, said critical radius being defined as a radius at which said inlet geometry and said nozzle present substantially similar resistance to expansion or motion of said bubble contained within said firing chamber.

10. The droplet generator of claim 9, wherein said outlet geometry further comprises a taper angle; said taper angle being small such that said critical radius can be approximated using an equation $2/rc = 1/h + 1/w$; wherein rc equals said critical radius, h equals a height of a rectangular opening in said inlet geometry, and w equals a width of said rectangular opening.

11. The droplet generator of claim 9, wherein said outlet geometry further comprises a taper angle; said critical radius being calculated using an equation wherein rc equals said critical radius of said outlet geometry, h equals a height of a rectangular opening in said inlet geometry, w equals a width of said rectangular opening, Pbp equals an internal backpressure, Pa equals atmospheric pressure, $\sigma$ equals fluid surface tension, and $\alpha$ equals said taper angle of said outlet geometry.

12. The droplet generator of claim 9, wherein said inlet geometry and said nozzle are configured such that said bubble contained within said firing chamber exits said firing chamber through said nozzle.

13. A method of manufacturing a self purging droplet generator comprising providing an outlet of a firing chamber of said droplet generator with a geometry that provides less resistance to a gas bubble forming in said firing chamber of said droplet generator than at an inlet of said firing chamber;

wherein said inlet comprises a throat and at least one island.

14. The method of claim 13, further comprising providing said outlet with an opening size sufficiently large that said outlet provides less resistance to said gas bubble forming in said firing chamber than does said inlet.

15. The method of claim 13, further comprising:

selecting parameters that define a desired standard of performance of said droplet generator;

defining geometry for a nozzle and a firing chamber to meet said parameters;

calculating maximum height and width combinations that describe a largest opening of said inlet; and calculating a critical minimum size for said nozzle based on said largest opening of said inlet.

16. The method of claim 15, wherein said parameters include droplet size.

17. The method of claim 15, wherein said maximum height and width combinations are approximated using an equation: $2/rc = 1/h + 1/w$; wherein rc equals said critical radius, h equals height of a rectangular opening in said inlet, and w equals a width of said rectangular opening.

18. The method of claim 13, further comprising locating said outlet proximate to a back wall of said firing chamber effective to improve uniformity of fluid flow through said firing chamber and reduce stagnation points between said back wall and said outlet.

19. The method of claim 13, wherein said inlet comprises plurality of islands.

20. The method of claim 13, wherein said inlet and outlet are formed such that a radius of curvature of said bubble is greater at said outlet than at said inlet.

* * * * *

UNITED STATES PATENT AND TRADEMARK OFFICE

CERTIFICATE OF CORRECTION

PATENT NO. : 8,919,938 B2
APPLICATION NO. : 12/743238
DATED : December 30, 2014
INVENTOR(S) : Garrett E. Clark et al.

It is certified that error appears in the above-identified patent and that said Letters Patent is hereby corrected as shown below:

In the Claims

In column 10, line 36, in Claim 19, delete “plurality” and insert -- a plurality --, therefor.

Signed and Sealed this
Twelfth Day of May, 2015

Michelle K. Lee

Michelle K. Lee
*Director of the United States Patent and Trademark Office*